US007837518B2

(12) United States Patent
Nicholson

(10) Patent No.: US 7,837,518 B2
(45) Date of Patent: Nov. 23, 2010

(54) CONNECTION DEVICE FOR AN UNDERWATER SERVICE LINE AND ASSOCIATED MOUNTING AND ROV HANDLE ASSEMBLIES

(75) Inventor: Joseph Allan Nicholson, Cumbria (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 391 days.

(21) Appl. No.: 12/089,283

(22) PCT Filed: Aug. 9, 2006

(86) PCT No.: PCT/GB2006/002966

§ 371 (c)(1),
(2), (4) Date: Apr. 4, 2008

(87) PCT Pub. No.: WO2007/048990

PCT Pub. Date: May 3, 2007

(65) Prior Publication Data

US 2008/0265563 A1 Oct. 30, 2008

(30) Foreign Application Priority Data

Oct. 25, 2005 (GB) ..... 0521734.4

(51) Int. Cl.
*H01R 4/18* (2006.01)

(52) U.S. Cl. ..... 439/730

(58) Field of Classification Search ..... 439/730, 439/191, 347

See application file for complete search history.

(56) References Cited

U.S. PATENT DOCUMENTS 4,388,947 A * 6/1983 Steuerwald ..... 137/614.06
5,771,974 A 6/1998 Stewart
6,112,769 A * 9/2000 Nicholson et al. ..... 138/109
6,511,335 B1 1/2003 Rayssiguier
6,679,724 B2 * 1/2004 Hillman et al. ..... 439/489
6,808,021 B2 10/2004 Zimmerman
7,261,162 B2 * 8/2007 Deans et al. ..... 166/336
7,295,013 B2 11/2007 Conti
2002/0022397 A1 * 2/2002 Hillman et al. ..... 439/489

(Continued)

FOREIGN PATENT DOCUMENTS

EP 0926422 9/2005

(Continued)

*Primary Examiner*—T C Patel
*Assistant Examiner*—Harshad C Patel

(57) ABSTRACT

There is disclosed a connection device for an underwater service line, the connection device comprising: a male connector having slidably interengageable first and second pieces, the first piece having a rearwardly facing surface and being slidable between a retracted position and an extended position; and a female connector connectable with the male connector and having a body—comprising a bore to receive the male connector, the female connector comprising an engagement member engageable with the first piece and movable from an extended position, in which it extends into the bore, to a retracted position, in which it permits forward displacement of the first piece, a biasing means biasing the engagement member towards its extended position, a forward end of the second piece being configured to allow the engagement member to extend into the bore, giving rise to a connected condition, wherein: in the connected condition, the forward end of the second piece is engageable with the engagement member upon retraction of the second piece so as to move the engagement member into its retracted position.

9 Claims, 12 Drawing Sheets

U.S. PATENT DOCUMENTS

| | | | | |
|---|---|---|---|---|
| 2005/0189115 | A1 | 9/2005 | Rytlewski | |
| 2006/0003626 | A1 | 1/2006 | Roberts | |
| 2006/0226842 | A1 | 10/2006 | Conti | |
| 2009/0047815 | A1* | 2/2009 | Nicholson | 439/281 |

FOREIGN PATENT DOCUMENTS

| | | |
|---|---|---|
| EP | 1133016 | 11/2005 |
| GB | 1294847 | 11/1972 |
| GB | 2294962 | 5/1996 |
| GB | 2365895 | 2/2002 |
| GB | 2366673 | 3/2002 |
| GB | 2425182 | 10/2006 |

* cited by examiner

CONNECTION DEVICE FOR AN UNDERWATER SERVICE LINE AND ASSOCIATED MOUNTING AND ROV HANDLE ASSEMBLIES

The present invention relates to an underwater mateable connection device which may be used for providing a high integrity coupling for an underwater service line, such as an electrical hydraulic or fibre-optic service line, using remotely operated vehicles (ROV's) in deep water or offshore subsea equipment. The present invention also relates to a means of mounting such a connection device.

ROV's are robotic vehicles which swim underwater on an umbilical tether which provides them with electrical power and control signals. The ROV's are operated by operators from the surface on a vessel or platform. ROV's can carry out a multitude of tasks using hydraulically operated tools and manipulators. The ROV's carry lights and cameras to enable them to be precisely controlled and operated as they are propelled underwater by hydraulic or electric thrusters.

There is a continually growing need for connection systems to provide evermore services to subsea equipment, particularly in oil and gas, military and power generation applications. Connections have to be remotely connected, often in dark and inhospitable environments where visibility is poor, thus creating difficulties for the ROV operator who must rely on the lights and cameras to position and operate the ROV to perform connection tasks.

Successful connection of such connection devices relies heavily on connector design and construction. In particular, the connector must be robust, so as to withstand very high forces generated by the ROV's, yet light and compact for ease of operation and so as to reduce deployment time and costs.

Moreover, multi-pin connection systems require orientation alignment, usually effected by physical keys and keyways in the connector mating shells. In such systems, the ROV operator requires visual indicators to align and orient the connectors during mating, as well as a visual means of identifying when the connectors are correctly mated and latched so that the connector does not release unexpectedly and fall to the ocean floor.

In order to allow the connectors to be aligned correctly with relative ease, it is desirable to provide the connectors with a means of articulating, as well as some compliance in their mounting arrangement whereby heavy loads and forces generated by the ROV and its manipulator can be avoided and/or absorbed.

Current connector systems do not entirely address these issues satisfactorily. In particular, current means of determining the successful latching and de-latching in such connector systems during operation are generally unreliable.

There is therefore a need for an improved means of latching, locking and mounting mateable connectors for concentric or multi-pin devices.

According to a first aspect of the invention, there is provided a connection device for an underwater service line, the connection device comprising:

a male connector arranged to hold a free end of the service line, the male connector having a first piece and a second piece which is interengageable with the first piece, the first piece having a rearwardly facing surface and being slidable with respect to the second piece, along a longitudinal axis of the male connector, between a retracted position, in which the rearwardly-facing surface is adjacent to a forward end of the second piece, and an extended position, in which the rearwardly-facing surface is remote from the forward end of the second piece; and a female connector, arranged to hold a connection point to be connected with the free end of the service line, the female connector being connectable with the male connector and having a body comprising a bore within which the male connector is receivable, the female connector further comprising an engagement member which is engageable with the first piece to be movable from an extended position, in which it extends radially into the bore, to a retracted position, in which it is radially retracted with respect to the bore to permit forward displacement of the first piece, the female connector being provided with a biasing means to bias the engagement member towards its extended position, the forward end of the second piece being configured to allow the engagement member to extend into the bore, upon the first piece being advanced therepast, to be engageable with the rearwardly-facing surface to prevent retraction of the first piece, giving rise to a connected condition in which the free end of the service line is connected with the connection point, wherein:

in the connected condition, the forward end of the second piece is arranged to engage the engagement member upon retraction of the second piece so as to move the engagement member into its retracted position, such that the engagement member is disengaged from the rearwardly-facing surface to permit retraction of the first piece from the bore, giving rise to a disconnected condition.

According to a second aspect of the invention, there is provided the male connector of a connection device according to the first aspect.

According to a third aspect of the invention, there is provided the female connector of a connection device according to the first aspect.

According to a fourth aspect of the invention, there is provided a mounting assembly for mounting an underwater service line connector to an underwater structure, the mounting assembly comprising:

a first member arranged to be fixed with respect to the underwater structure, the first member having an opening therethrough;

a second member, arranged to be fixed with respect to the connector and receivable in the opening to define an annular clearance between the first and second members; and compliant coupling means, the compliant coupling means being receivable in the annular clearance and being interengageable with the first and second members to allow a degree of axial and/or radial movement of the second member with respect to the first member.

According to a fifth aspect of the invention, there is provided a mounting assembly according to the fourth aspect which is adapted to mount a connector according to the second or third aspect.

According to a sixth aspect of the invention, there is provided an ROV arm assembly, the ROV arm assembly comprising:

a first end arranged to be engaged by an ROV;

a second end arranged to be engaged with an item to be manipulated by the ROV; and at least one elongate member extending between the first and second ends, the or each elongate member comprising an inner member made from a relatively rigid material and an outer member made from a relatively compliant material.

Preferably, the ROV arm assembly comprises two elongate members arranged side-by-side. Preferably, the relatively rigid material comprises Inconel. Preferably, the relatively compliant material comprises Acetal.

A preferred embodiment of the present invention will now be described in detail with reference to the accompanying drawings, in which.

Figure 3A:
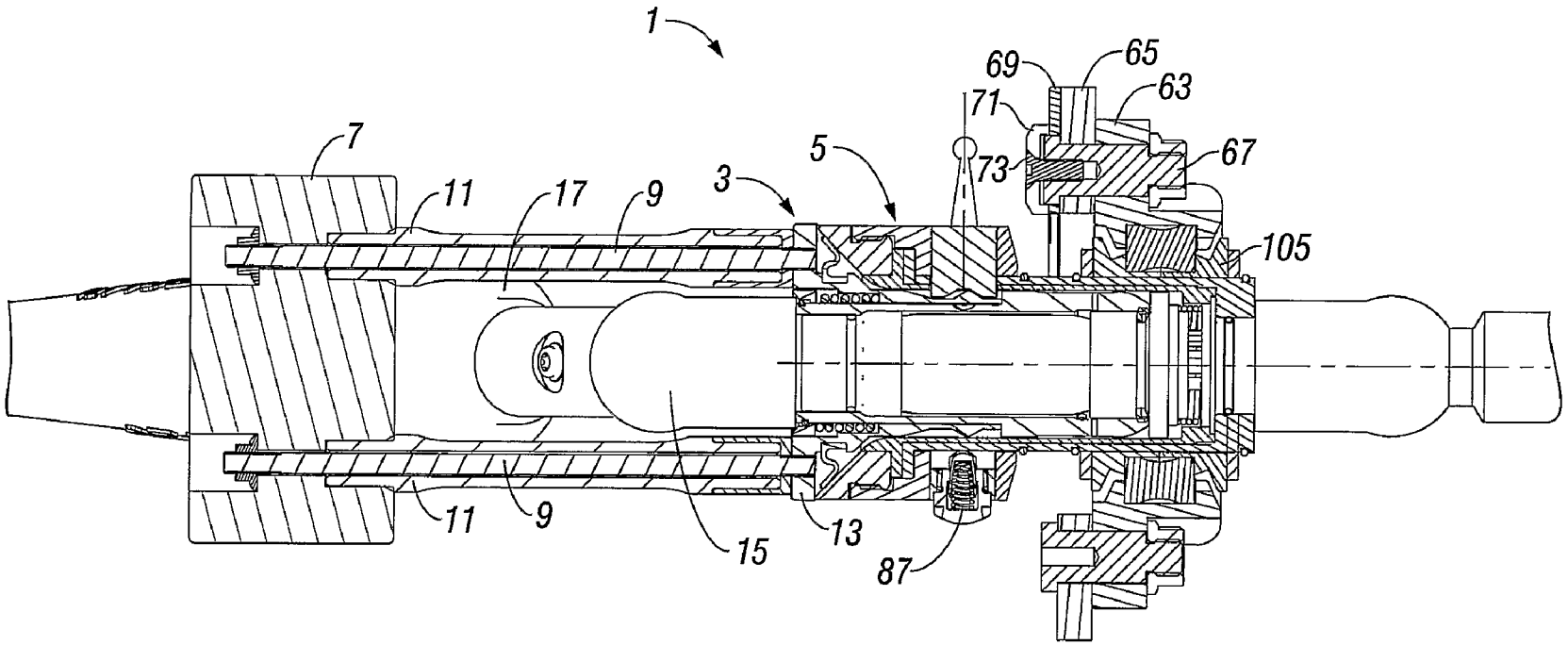
FIG. 3A is a side cross-sectional view of the male and female connectors in a connected condition.

The connection device 1 according to the preferred embodiment is shown in a connected condition in FIG. 3A.

It will be appreciated that terms such as "front", "forward", "rear", "rearward" and related terms are used with respect to the direction of insertion of the male connector into the female connector, that direction being the "forward direction". Correspondingly, the female connector is positioned "in front of" the male connector immediately prior to insertion.

The connection device 1 comprises a male connector 3 and a female connector 5 which is mateable with the male connector 3. The male connector 3 is mounted to a paddle handle 7 by a pair of tie rods 9. In an alternative embodiment, the paddle handle could be replaced by a T-bar or other arrangement, as required by the operator.

The paddle handle 7 (ROV handle) is grasped by a gripper of an ROV to enable connection and disconnection of the connection device 1. Each tie rod 9 is made of Inconel and is received in a sleeve 11 made of Acetal, the tie rods 9 and sleeves 11 defining ROV handle arms. The tie rods 9 are made of steel and the sleeves are made of acetal plastic. The tie rods are sufficiently slender to allow some compliance between the paddle handle 7 and the male connector 3, thus enabling the male connector 3 and tie rods 9 to cope with transverse loads during connection and disconnection of the connection device 1. Front ends of the tie rods 9 are screwed into a flange 13 provided at the rear of the male connector 3 and rear ends of the tie rods are received through holes in the paddle handles 7 and bolted to the paddle handle 7. The holes in the paddle handle 7 are increased in diameter at the front ends of the paddle handle 7 so as to fittingly receive rear ends of the sleeves 11.

The male connector 3 comprises a body 15 into which the end of an electrical cable (17) (service line) is received and held. The cable 17 meets the body 15 at an angle (of approximately 60 degrees in this embodiment), as can be seen clearly in FIG. 2A, so as not to interfere with operation of the paddle handle 15 by the ROV unit.

In this embodiment, the electrical connection incorporates a multi-pin 7-way electrical contact arrangement 19, as can best be seen in FIG. 2B, thus necessitating rotational orientation features, as will be discussed further below. It will be appreciated that other embodiments may incorporate service lines which do not require rotational orientation, such as single line large bore-hydraulic lines or concentric electrical lines.

Figure 2A:
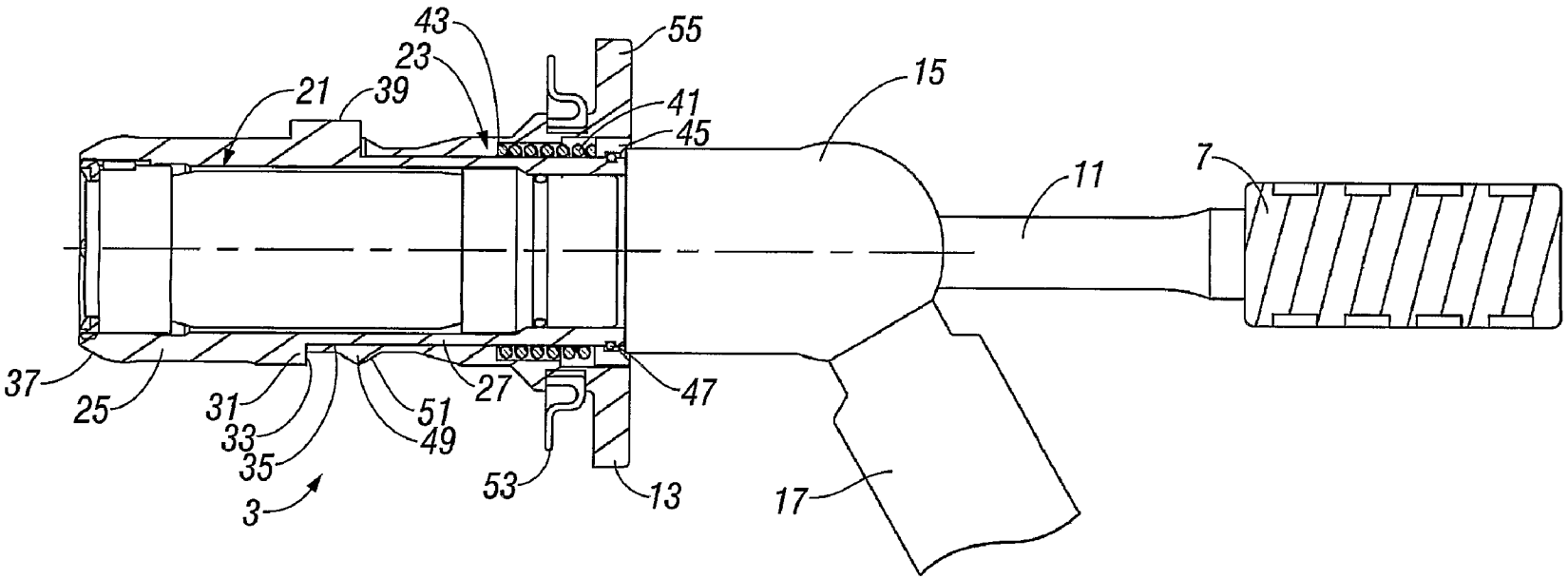
FIG. 2A is a side cross-sectional view of a male connector according to the preferred embodiment.
Figure 2C:
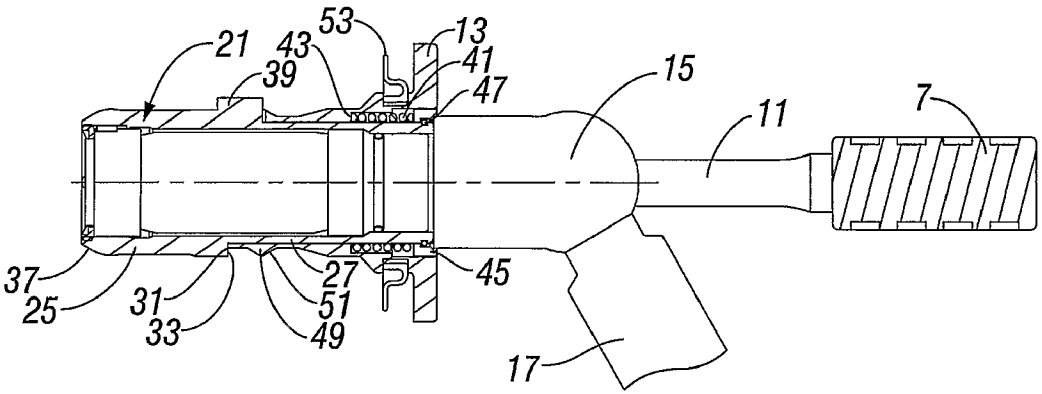
FIG. 2C is a further side cross-sectional view of the male connector shown in FIG. 2A.
Figure 2B:
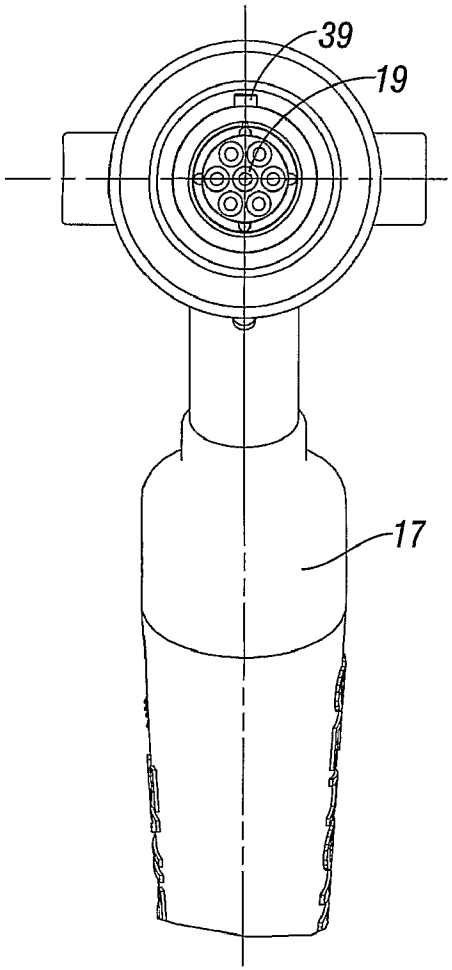
FIG. 2B is a front view of the male connector shown in FIG. 2A.

A larger view of the mate connector 3 is shown in FIG. 2A. The male connector 3 comprises a cylindrical first piece 21 which is received in a second piece 23 which functions as a release sleeve. The first piece 21 comprises a front section 25 and a rear section 27, the front section 25 having a greater diameter than the rear section 27 such that only the rear section 27 is receivable in the second piece 23 an annular shoulder 31 is thus defined at the junction between the front section 25 and the rear section 27, the shoulder 31 offering a rearward facing surface 33 which abuts a front end 35 of the second piece 23 when the first piece 21 is in a retracted position as shown in FIG. 2A.

The first piece 21 comprises a tapered tip 37. The first piece 21 further comprises a key 39 for ensuring correct rotational orientation of the male connector 3 during connection with the female connector 5. The key 39 is provided on the front section and extends radially outwardly therefrom.

Figure 5A:
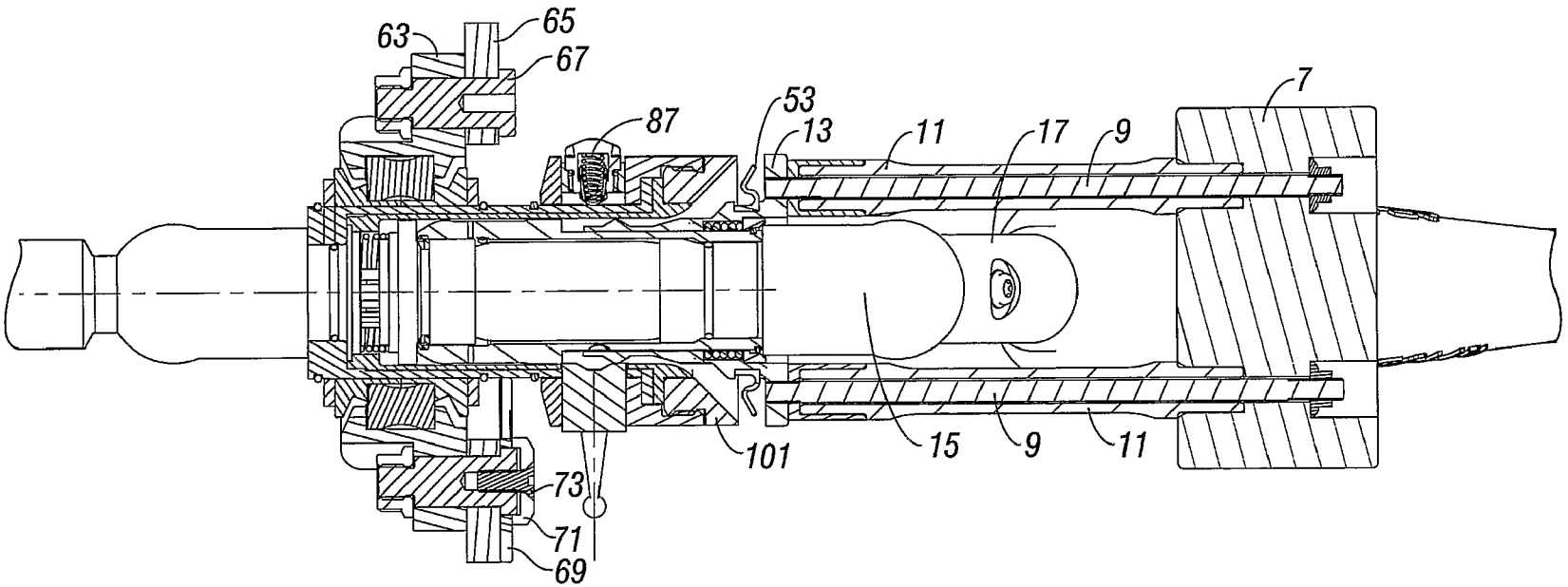
FIG. 5A is a side cross-sectional view showing a configuration of the connection device during disconnection of the male connector from the female connector.
Figure 5B:
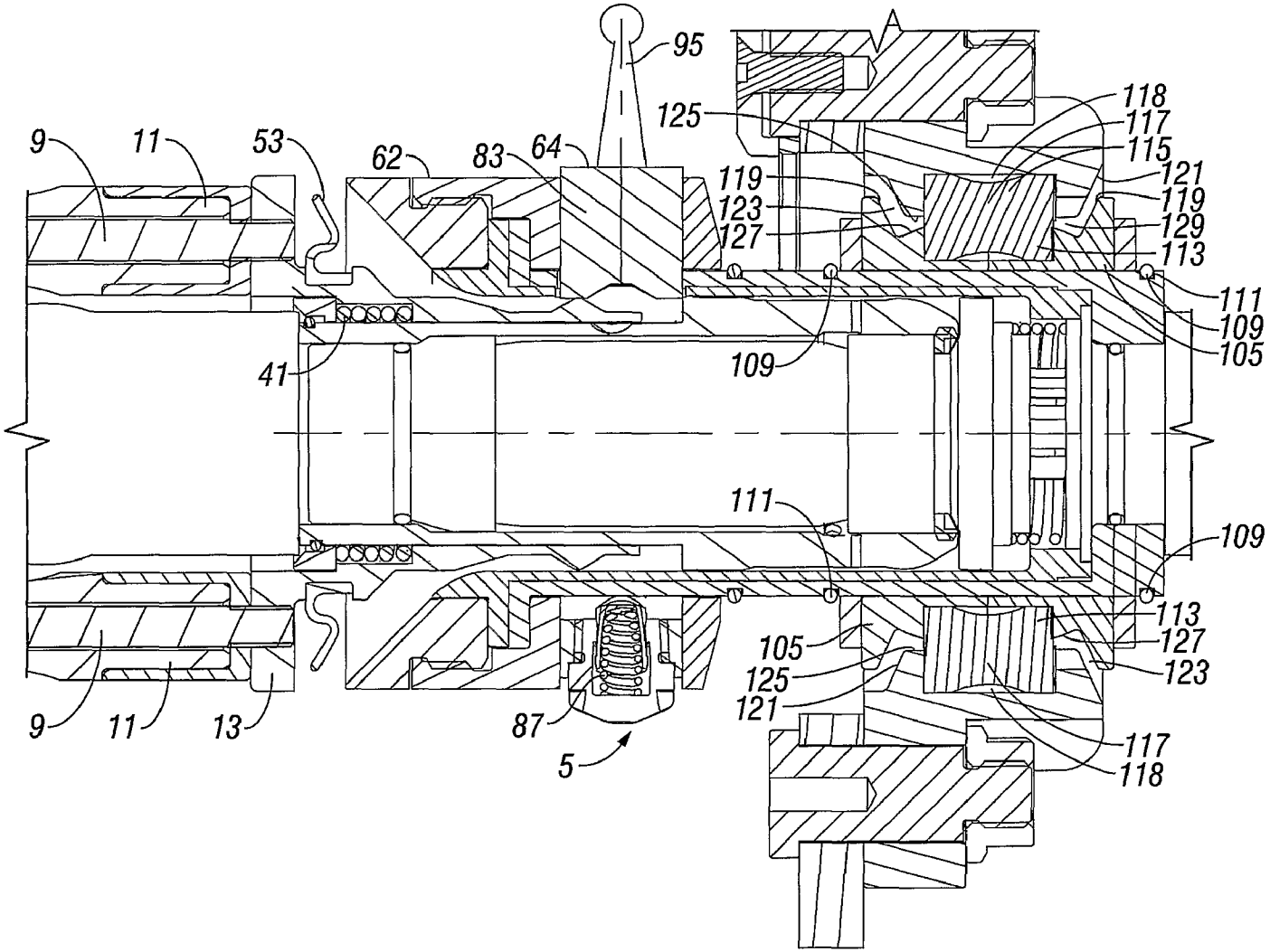
FIG. 5B is a detailed side cross-sectional view of the male and female connectors during disconnections.

The first piece 21 is slidably moveable with respect to the second piece 23, along a longitudinal axis (shown in broken lines in FIG. 2A) of the male connector 3, between the retracted position, in which the rearward facing surface 33 is adjacent to the end 35 of the second piece 23, and an extended position, in which the rearward-facing surface 33 is remote from the end 35 of the second piece 23. The extended position can be seen in FIGS. 5A and 5B. A spring 41 biases the first piece 21 into its retracted position, the spring 41 being provided in an annular space defined between the first piece 21 and second piece 23. One end of the spring 41 engages a rearward-facing surface 43 of the second piece 23 and the other end of the spring 41 engages an opposing forward-facing surface which is offered by a reaction ring 45 which is mounted to the first piece 21 by a circlip 47 received in an annular groove provided in the first piece 21 and a recess defined between the first piece 21 and the reaction ring 45. As is clear from FIG. 2A, a pulling force on the first piece 21 will cause the spring 41 to be compressed in the annular space so as to provide the biasing function.

The second piece 23 is provided at its front end 35 with an annular projection 49 which defines a "bump" profile and which comprises a tapered rear wall 51. The projection 49 extends radially outwardly at least as far as, if not further than, the front section 25 of the first piece 21, i.e. the greatest diameter of the annular projection 49 is equal to or exceeds the diameter of the front section 25. The projection 49 extends substantially around the circumference of the second piece 23.

An annular debris seal 53 is provided towards the rear end of the second piece 23 and is engageable with an end of the female connector 5 upon connection therewith so as to prevent ingress of sand or silt into the connection device 1. The flange 13, provided at the rear end of the male connector 3, forms part of the second piece and is arranged to be received against the free end of the female connector 5 upon connection of the connection device 1.

Figure 1B:
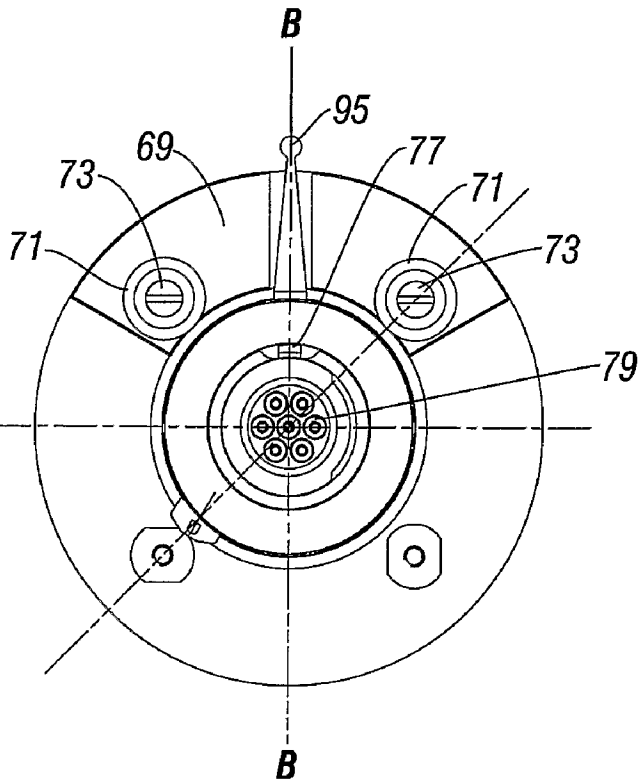
FIG. 1B is a front view of the female connector shown in FIG. 1.
Figure 1A:
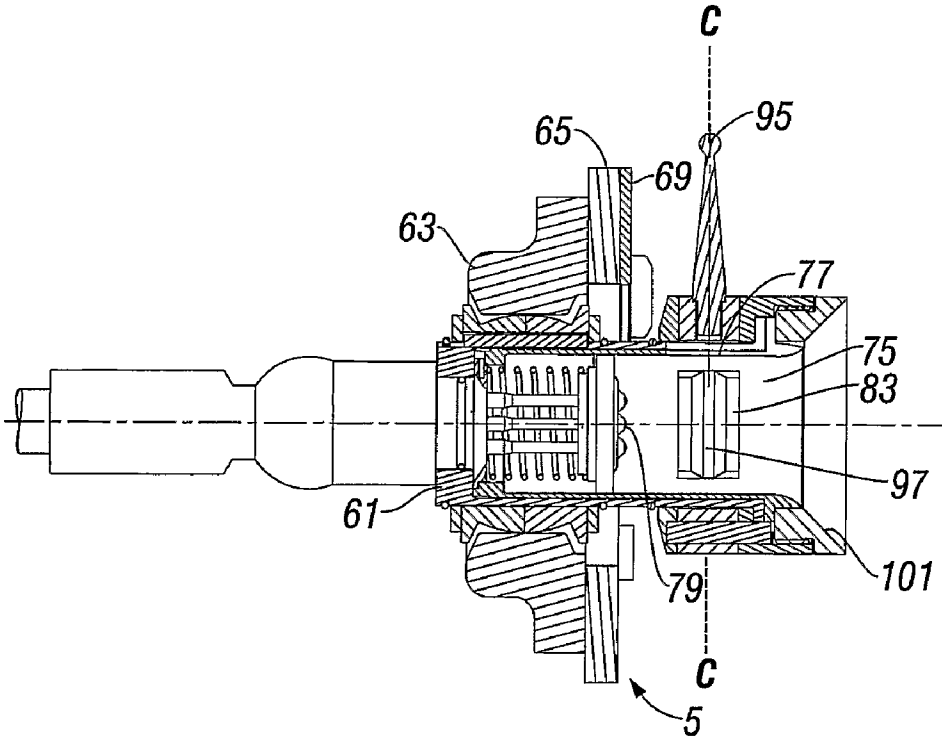
FIG. 1A is a side cross-sectional view of a female connector according to a preferred embodiment of the invention.
Figure 1C:
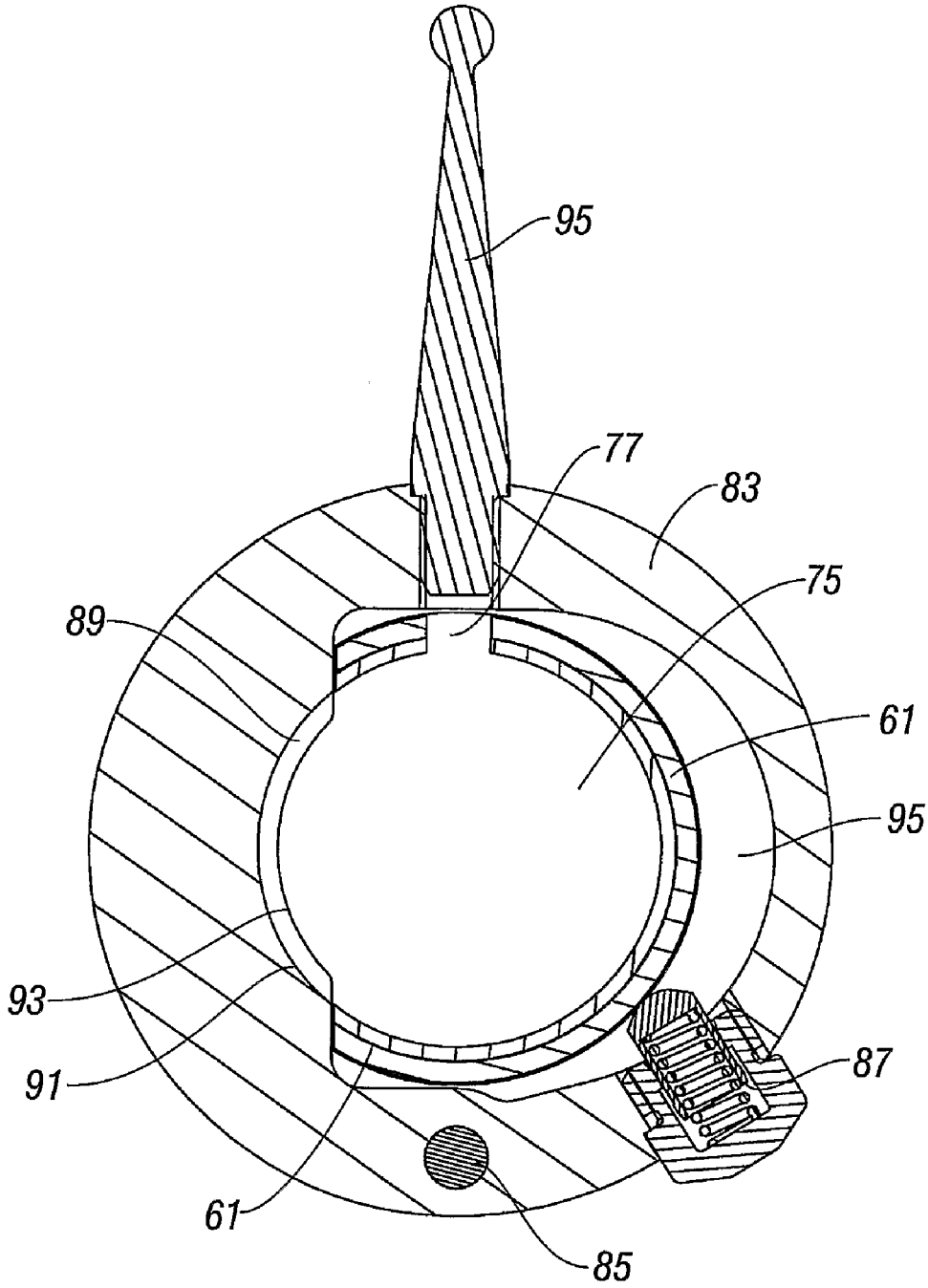
FIG. 1C is a cross-sectional view taken through section C-C shown in FIG. 1A.
Figure 1D:
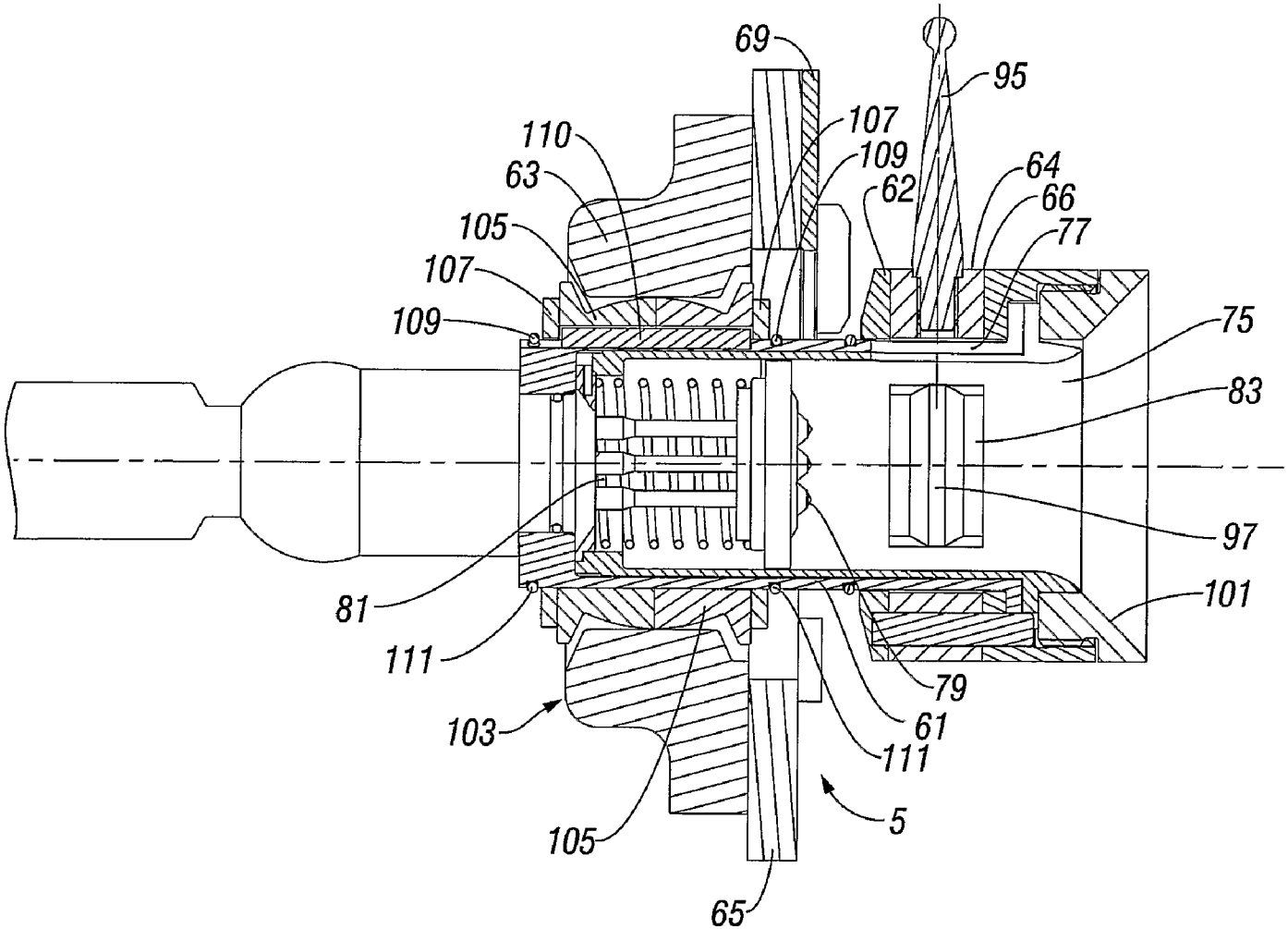
FIG. 1D is a side cross-sectional view taken through section B-B shown in FIG. 1B.

The female connector 5 is shown in detail in FIGS. 1A and 1D.

The female connector 5 houses an end of a further length of service line (electrical cable), to which the end of the electrical cable 17 is to be connected, The female connector comprises a body 61 and is provided with a flange 63 for mounting the female connector 5 to a mounting plate 65 which is, in turn, fixed to, or forms part of, an underwater superstructure. The flange 63 and mounting plate 65 are provided with through-holes around their circumferences which receive bolts for securing the flange 63 to the mounting plate 65. An indicator plate 69 is fixed to the opposite face of the mounting plate 65 by washers 71 retained against bolts 67 by screws 73. The indicator plate 69 extends around only a portion of the circumference of the mounting plate 65. The function of the indicator plate 69 will be described further below.

The body 61 has a cylindrical bore 75 having a diameter which closely matches that of the front section 21 of the male connector 3 such that the male connector 3 is fittingly receivable in the female connector 5. The circumferential wall of the bore 75 is provided with a keyway 77 which receives the key 39 extending from the front section 21 of the male connector 3, thus ensuring alignment of the terminal arrangement 19 in the male connector 3 with a corresponding terminal arrangement 79 provided in the female connector 5.

The corresponding terminal configuration 79 comprises male contact pins and is provided on an oil-filled spring-energised wiper system 81 as is known in the art.

Figure 4:
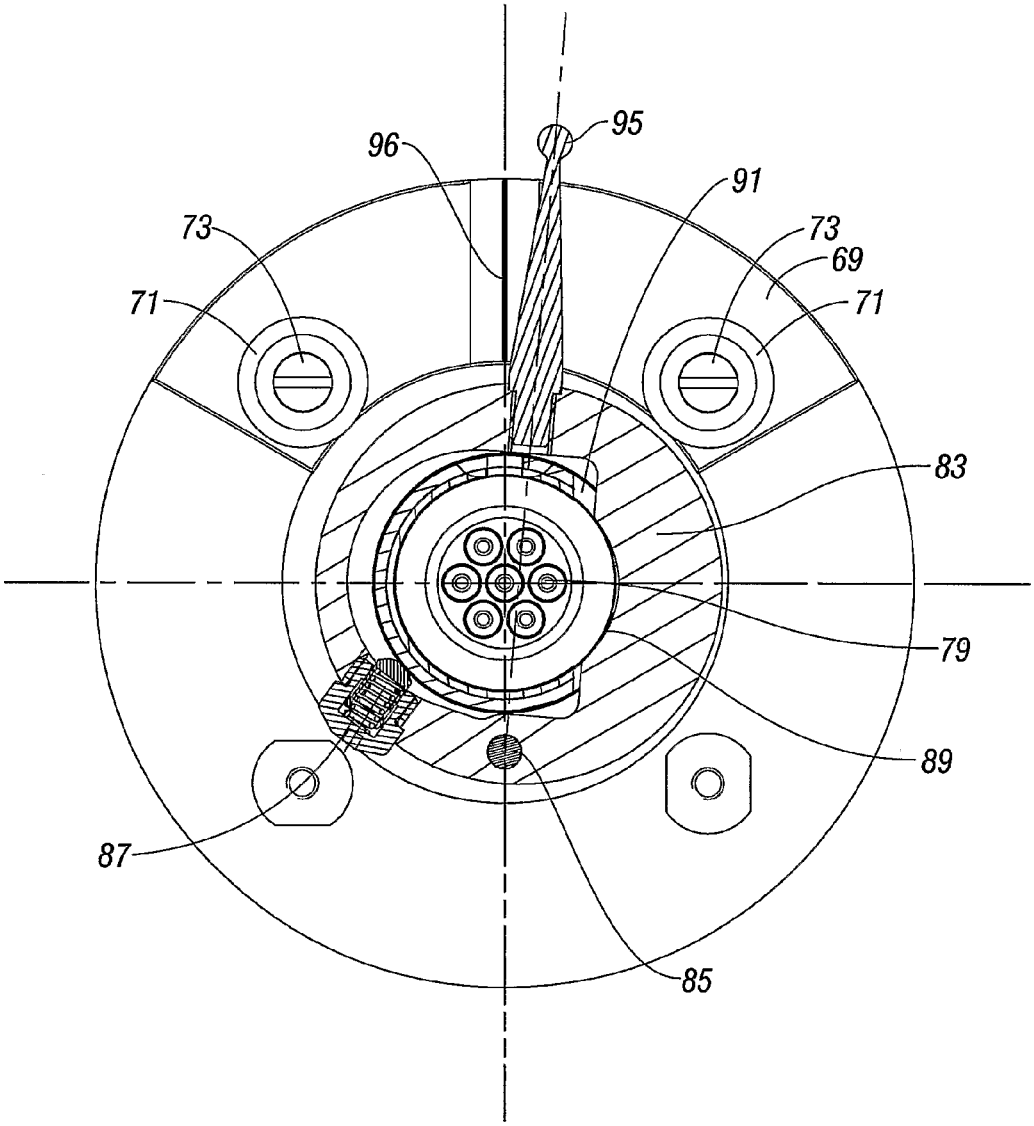
FIG. 4 is a front cross-sectional view of the female connector showing displacement of an indicator provided on that connector during connection.

The body 61 further comprises an engagement member in the form of a latch member 83, which is arranged to engage the male connector 3 to prevent disconnection of the connector 1 when in a connected condition. The latch member 83 is shown in front cross-section in FIG. 1C. The latch member 83 is generally ring-shaped and surrounds the bore 75. The latch member 83 is pivotally mounted to the body 61 at a pivot 85 so as to be able to rock between an extended position, as shown in FIG. 1C and a retracted position, as shown in FIG. 4. The latch member 83 is biased into its extended position by a spring-loaded piston 87 which is mounted to the latch member 83 and which acts against an outer surface of the body 61 to provide a biasing moment (which is clockwise in FIG. 1C) about the pivot 85. The latch member 83 comprises an engagement portion 89 which is received through an opening 91 which provides communication between the outside of the body 61 and the bore 75. The latch member 83 and slot 91 are configured such that the engagement portion 89 in its extended position extends around the bore 75 through an appreciable angle (approximately 90 degrees in this embodiment). A rear portion 93 of the engagement portion 89 is tapered to define an inclined face which is engageable with the tapered tip 37 of the male connector 3 during insertion of the male connector 3 into the bore 75, such that the latch member 83 is thereby displaced into its retracted position. A space 95 is provided between the body 61 and latch member 83 at the opposite side of the pivot 85 so as to allow the latch member 83 to be displaced into its retracted position.

An indicator arm 95 is mounted to the latch member 83, to be diametrically opposite the pivot 85, and extends radially outwardly therefrom. The indicator arm 95, which is visible to the ROV, provides an indication of the position of the engagement portion 89, as will be discussed further later.

Figure 3B:
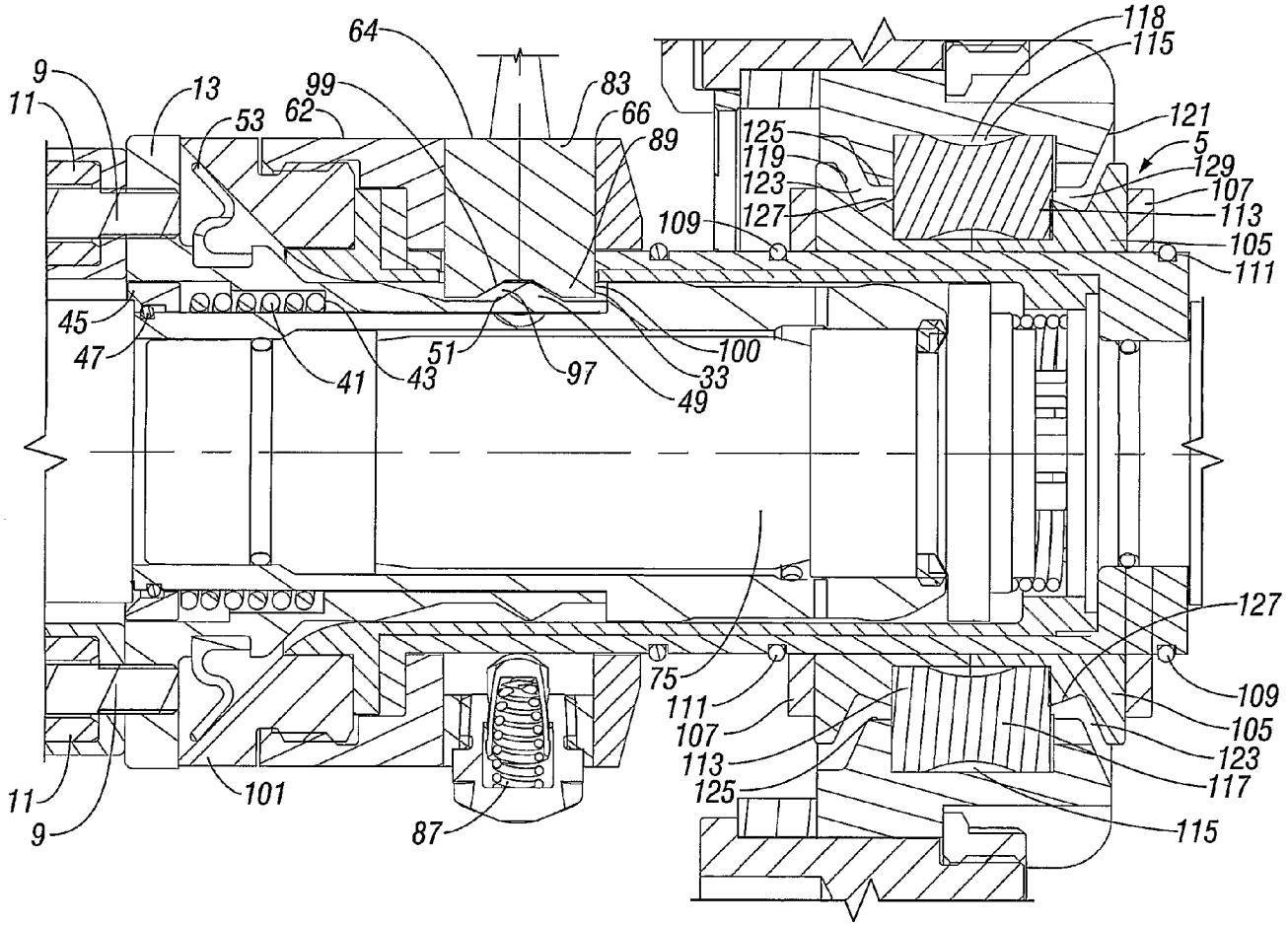
FIG. 3B is a detailed cross sectional view of the male and female connectors in a connected condition.

A side cross sectional view of the latch member as shown in FIG. 3B. As can be seen in that view, the engagement portion 89 is provided with a cavity 97. The cavity 97 faces into the bore 75 and extends along the entirety of the arcuate length of the engagement portion 89. The cavity 97 is arranged to accommodate the projection 49 on the second piece 23 of the male connector 3 when connected to the female connector 5, as can be seen in FIG. 3B. The cavity 97, comprises a rear wall 99 which is provided by the engagement portion 89, the rear wall 99 being arranged to engage the rear wall 51 of the projection 49 on the male connector 3 as will be discussed in further detail later.

The female connector 5 is provided at its rear end with a tapered lead-in 101 to assist with location of the male connector 3 during insertion thereof into the bore 75.

The details of the flange 63 and associated arrangement for mounting the female connector 5 will now be described.

The mounting arrangement is designed so as to provide compliance between the mounting plate 65 and the body 61 of the female connector 5. Specifically, the mounting arrangement allows the female connector 5 to be angularly deflected, by +/−5° with respect to the flange 63 (the flange consituting a "first member"), in any plane extending through its longitudinal axis. The mounting assembly configuration further enables the female connector 3 to rotate to an extent about its own longitudinal axis. The mounting assembly 103 comprises two opposed inner rings 105 (which together define an "inner member" or "second member") which are mounted in abutting relation over the body 61. The inner rings 105 are retained axially on the body 61 by a pair of washers 107 disposed by the side thereof, the washers held in position by circlips 109 received in annular grooves 111. The inner rings are rotationally retained on the body 61 by a key 110 received in opposed keyways provided in the inner rings and the body 61.

The inner rings 105 are each provided with an axially extending channel which is semi-circular in cross-section. The channels terminate at the abutted ends of the inner rings 105 to define semi-cylindrical recesses 13 disposed at separate positions around the circumference of the inner member 105.

Figure 6:
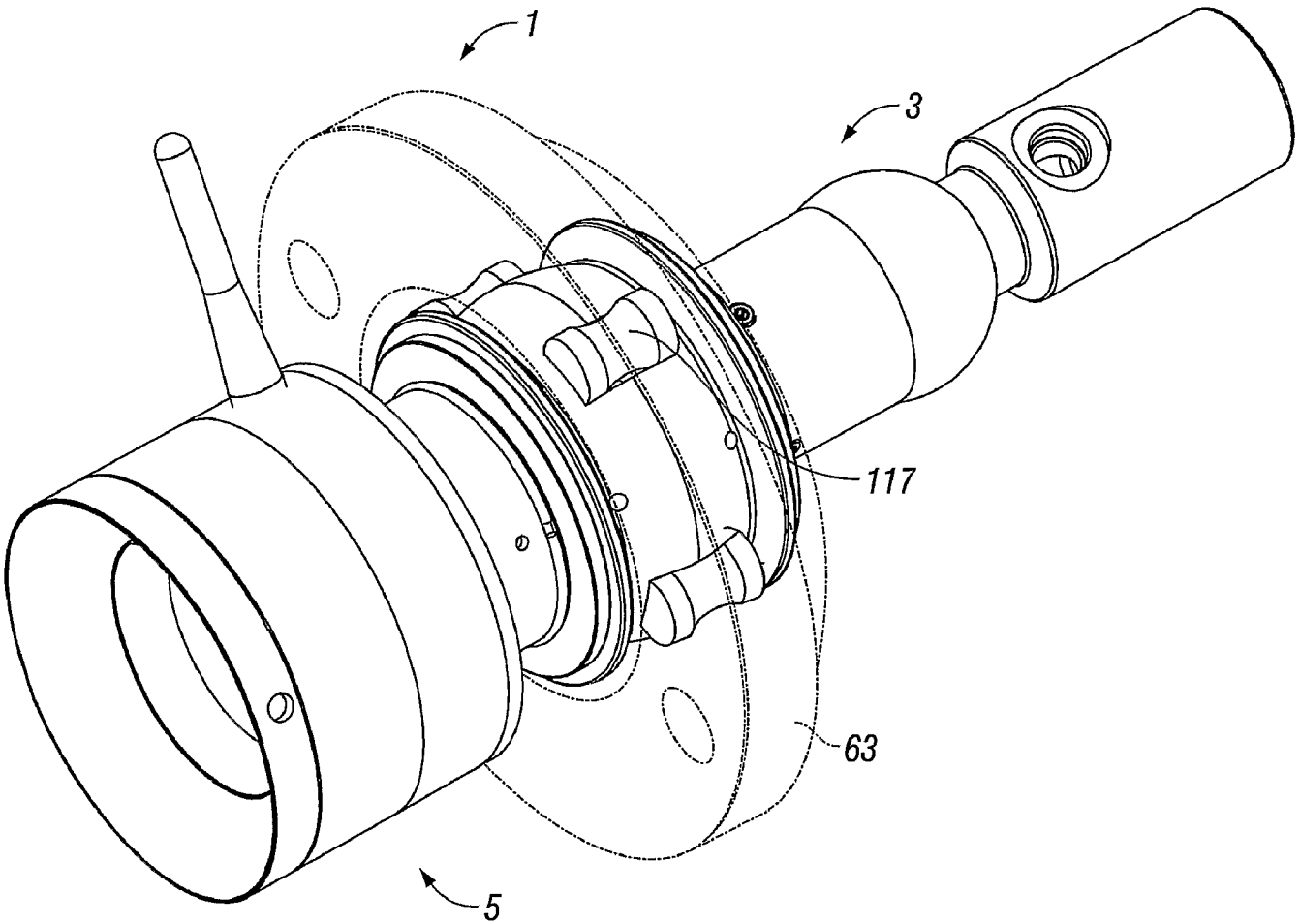
FIG. 6 is a three-dimensional view of the connection device with a flange thereof shown in phantom.
Figure 7:
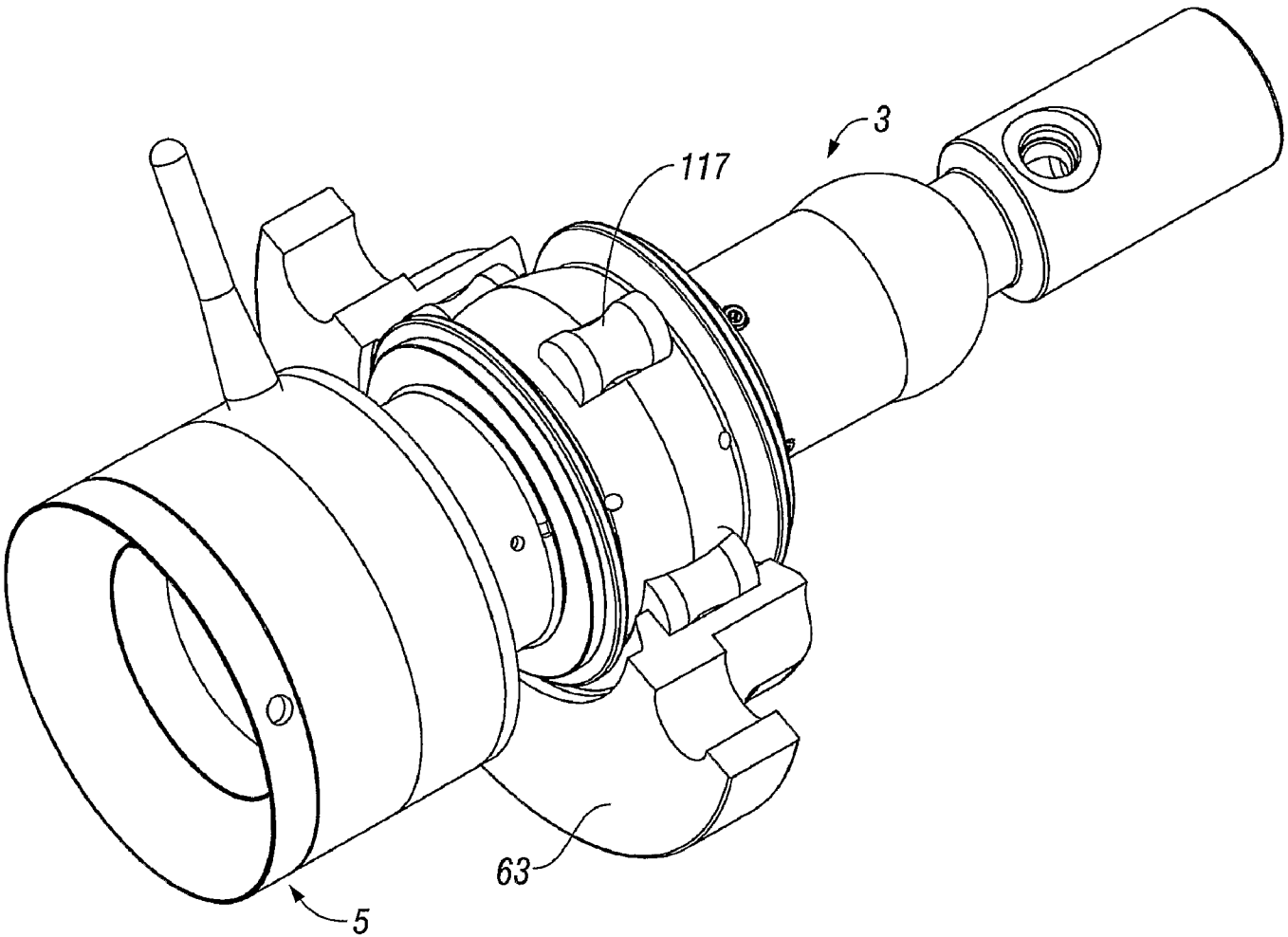
FIG. 7 is a further three-dimensional view of the connection device with a portion of the flange thereof cut away.

The flange 63 is configured to surround the inner member 105 and is also provided with an arrangement of semi-cylindrical recesses 115 which oppose the recesses 113 to define substantially cylindrical cavities, each of which holds a generally compliant element 117 which is made of rubber. The compliant elements 117 are closely received in the respective semi-cylindrical recesses and comprise sections of reduced diameter between their ends so as to define relief areas 118 between the rubber elements 115 and the circumferential walls of the recesses. The shape of the compliant elements 117 can be seen in FIGS. 6 and 7.

The inner rings 105 are provided, at their axially outer ends, with radially outward extending lips which define axially inward facing surfaces 119. The flange 63 extends radially inward so as to be received between the surfaces 119, thus defining axially outward facing surfaces 121 which oppose surfaces 119 with an axial clearance 123 therebetween. The surfaces 119 and 121 have a tapered profile, so as to be radially outwardly divergent.

The radially inner portions of the flange 63 define a radially inward facing surface 125 into which the semi-cylindrical channel 115 is provided. The inner rings 105 together provide radially outward facing surface 127 which opposes radially inward facing surface 125 in which the cylindrical recesses defined by the rings are provided. A radial clearance 129 separates the radially inward and outward facing surfaces. The radially outward facing surface 127 has a frusto-spherical profile to define relief portions. The configurations of the inner rings 125 and flange 63, in combination with the compliant elements disposed therebetween, enable the female connector 5 to move, to an extent, axially and radially with respect to the flange 63, as well as rotationally about its own longitudinal axis or any transverse axis, thereby affording the female connector 5 excellent compliance characteristics.

The flange 63 is constructed from an electrically non-conducting material such as acetal thermoplastic. Owing to the non-conductivity of the flange 63, the female connector 5 is electrically isolated from the mounting plate 65 thus preventing deposition of calcareous precipitates from marine corrosion protection system anodes which may be electrically connected to the mounting plate.

The body 61 is configured for closely receiving the latch member 83 therein and such that it has an outer circumferential wall 62 (see FIGS. 3A and 3B) which is substantially flush with an outer circumferential surface 64 of the latch member 83, such that there are defined shear lines 66 along which the outer circumferential surface 64 is displaced with respect to the outer circumferential surface 62 during movement of the latch member 83, so as to dislodge accumulated marine growth and deposits which gather on and near the latch member 83.

The connection and disconnection of the connectors 3 and 5 will now be described.

To connect the connectors 3 and 5, an ROV gripper grasps the paddle handle 7 and by manipulation thereof guides the male connector 3 towards the female connector 5 so as to introduce the front section 25 through the lead-in 101 and into the bore 75 such that the key 39 is received into the keyway 77. The lead-in 101 may assist in the correct alignment of the male connector 3 during insertion. The ROV then advances the male connector 3 forwards so that the tapered tip 37 of the male connector 3 engages the tapered surface 93 of the engagement portion 89, thereby causing displacement of the latch member 83 into its retracted position with continued insertion of the male connector 3 and thus permitting the front section 25 to be advanced past the latch member 83. Movement of the latch member 83 into its retracted position causes the outer circumferential surface 64 to be displaced relative to the outer circumferential surface 62 so as to dislodge marine deposits. Furthermore, such displacement causes the indicator arm 95 to be angularly displaced with respect to an indicator line 96 on the indicator plate 69 (see FIG. 4), thus providing a clear indication to the ROV operator that the latch member 83 has been displaced into its retracted position.

The ROV continues to advance the male connector 3 into the bore 61 until such time as the rearwardly facing surface 33 is displaced past the latch member 83, whereupon the latch member 83 reverts, under the action of the spring-loaded piston 87, towards its extended position, such that a forward-facing surface 100 of the engagement portion 89 is positioned to abut the rearwardly facing surface 33 to prevent retraction of the first piece 25 (see FIG. 3B). This gives rise to a connected condition, in which the contact pins in the male and female connectors are in contact and the oil-filled spring energised wiper system 81 has been forwardly displaced. In this condition, the projection 49 on the male connector 3 is accommodated in the cavity 97. Also, during and after connection, the debris seal engages the tapered face of the lead-in 101 to prevent sand or silt entering the latch assembly, the flange 13 being received against the lead-in.

Upon the latch member 83 reverting towards Its extended position, the indicator arm 95 is angularly displaced back towards the indicator line 96 to provide visual conformation that the male connector 3 has been fully inserted. During the connection process, the mounting assembly permits the female connector 5 to move translationally and rotationally so as to be able to cope with the loads exerted upon it during insertion of the male connector 3. However, over-articulation of the female connector 5 with respect to the flange 63 is prevented by engagement between one of the axially inward facing surfaces 119 with the opposing axially outward facing surface 121. Moreover, excessive transverse displacement of the female connector 5 with respect to the flange 63 is prevented by engagement between the radially outward facing surface 127 and radially Inward facing surface 125. A small degree of swivel of the female connector 5 with respect to the flange 63 is also permitted by the compliant elements 117.

After connection, the ROV gripper is disengaged from the paddle handle 7.

In order to disconnect the male connector 3 from the female connector 5, the ROV gripper grips the paddle handle 7 and applies a pulling force through the tie rods 9 against the flange 13. This causes retraction of the second piece 23, against the biasing force of the spring 41, though not the first piece 21 which is prevented from rearward movement by the latch member 83. Retract on of the second piece 23 brings the rearwardly facing surface 51 of the projection 49 into engagement with the rear wall 99 of the cavity 97, thus causing retraction of the latch member 83 until the projection 49 is clear of the cavity 97 at which point the forwardly facing surface 100 of the latch member 83 has been disengaged from the rearwardly facing surface 33, thus allowing retraction of the first piece 21 and therefore causing the first piece 21 to revert to its retracted position under the restoring force of the spring 41.

The connection device 1 according to the preferred embodiment offers numerous advantages. Firstly, the connection device 1 is configured to be connected and disconnected merely by linear motion of the male connector 3 with respect to the female connector 5, thus eliminating complicated operation of the ROV. In addition, the resistance to retraction of the second piece 23 when the male and female connectors are connected, as offered by the biasing spring 41, provides a means of ensuring that the connectors will be disconnected only upon the application of a predetermined pulling force, such that inadvertent disconnection, which may otherwise be caused by accidental forces upon the paddle handle 7, can be prevented. Moreover, such biasing creates a spring-assisted ejection facility which facilitates disconnection. Furthermore, the indicator arm and plate arrangement provides a simple and reliable means of establishing the position of the latch member 83 and thus whether the connectors are connected or disconnected. In addition, the embodiment exploits, by way of the above-described shear line arrangement, movement of the latch member 83 for the purposes of dislodging marine growth from the connection device 1. Moreover, the configuration of the mounting assembly affords the female connector 5 exceptional compliance characteristics with a "dead-stop" feature provided by the opposed axially and radially outwardly and inwardly facing surfaces provided on the flange and inner rings, thus preventing excessive axial, radial and rotational displacement of the female connector 5 with respect to the flange 63. Further still, the connection device 1 may be of a particularly robust, yet relatively light-weight design.

The invention claimed is:

1. A connection device for an underwater service line, the connection device comprising:

a male connector arranged to hold a free end of the service line, the male connector having a first piece and a second piece which is interengageable with the first piece, the first piece having a rearwardly facing surface and being slidable with respect to the second piece, along a longitudinal axis of the male connector, between a retracted position, in which the rearwardly-facing surface is adjacent to a forward end of the second piece, and an extended position, in which the rearwardly-facing surface is remote from the forward end of the second piece; and a female connector, arranged to hold a connection point to be connected with the free end of the service line, the female connector being connectable with the male connector and having a body comprising a bore within which the male connector is receivable, the female connector further comprising an engagement member which is engageable with the first piece to be movable from an extended position, in which it extends radially into the bore, to a retracted position, in which it is radially retracted with respect to the bore to permit forward displacement of the first piece, the female connector being provided with a biasing means to bias the engagement member towards its extended position, the forward end of the second piece being configured to allow the engagement member to extend into the bore, upon the first piece being advanced therepast, to be engageable with the rearwardly-facing surface to prevent retraction of the first piece, giving rise to a connected condition in which the free end of the service line is connected with the connection point, wherein:

in the connected condition, the forward end of the second piece is arranged to engage the engagement member upon retraction of the second piece so as to move the engagement member into its retracted position, such that the engagement member is disengaged from the rearwardly-facing surface to permit retraction of the first piece from the bore, giving rise to a disconnected condition.

2. A connection device according to claim 1, comprising a further biasing means arranged to bias the first piece towards its retracted position.

3. A connection device according to claim 1, wherein the engagement member is provided with a forward-facing surface, the forwardly-facing surface being engageable with the rearwardly-facing surface in the connected condition, the forwardly and rearwardly-facing surfaces being configured such that they are substantially perpendicular to the longitudinal axis in the connected condition.

4. A connection device according to claim 1, wherein the end of the second piece comprises a radially outwardly extending projection which is arranged to be received in a cavity in the connected condition, the cavity having a rear wall defined by the engagement member, the projection having a rear face engageable with the rear wall of the cavity to move the engagement member into its retracted position.

5. A connection device according to claim 4, wherein the rear face of the projection and/or the rear wall of the cavity is inclined with respect to the longitudinal axis.

6. A connection device according to claim 1, wherein the engagement member is closely received in an opening which extends to an outer wall of the body, a radially outer portion of the engagement member being configured to extend radially outwardly from the opening in one, though not the other, of the retracted and extended positions of the engagement member, thereby defining at least one shear line between the engagement member and the outer wall.

7. A connection device according to claim 1, wherein the engagement member is mounted to the body by a pivot so as to be pivotably movable, with respect to the body, between its extended and retracted positions.

8. A connection device according to claim 1, wherein the engagement member is provided with an indicator element, the indicator element arranged to be visible from the outside of the connection device during connection and disconnection of the device and to be movable with the engagement member to indicate the position of the engagement member.

9. A connection device according to claim 8, wherein the indicator element comprises an arm which extends radially outwardly from the engagement member.

* * * * *